United States Patent [19]

Wilcox

[11] 4,183,695

[45] Jan. 15, 1980

[54] COLLAPSIBLE BARRICADE

[76] Inventor: Ernest J. Wilcox, 411½ E. Main St., Montezuma, Iowa 50171

[21] Appl. No.: 938,065

[22] Filed: Aug. 30, 1978

[51] Int. Cl.[2] ..... E01F 13/00

[52] U.S. Cl. ..... 404/6; 256/13.1; 256/1; 116/63 R; 40/606

[58] Field of Search ..... 404/6, 9, 10; 40/606, 40/607, 612; 256/1, 13.1; 403/2; 116/63 R, 63 P, 63 T; 248/472; 49/35

[56] References Cited

U.S. PATENT DOCUMENTS

| | | | |
|---|---|---|---|
| 810,260 | 1/1906 | Bugby | 256/13.1 X |
| 1,858,152 | 5/1932 | Hallowell | 40/606 |
| 2,101,176 | 12/1937 | Height | 256/13.1 |
| 2,515,313 | 7/1950 | Nember | 40/606 |
| 2,863,238 | 12/1958 | Keech | 40/606 |
| 2,869,504 | 1/1959 | Andrews | 116/63 T |
| 2,887,983 | 5/1969 | Budd | 116/63 P |
| 3,061,960 | 11/1962 | Dull | 49/35 |
| 3,123,041 | 3/1964 | Gunderson | 248/472 |
| 3,262,415 | 7/1966 | Biscardi | 116/63 R |
| 3,308,584 | 3/1967 | Graham | 256/13.1 X |
| 3,444,838 | 5/1969 | Harkins | 116/63 R |
| 3,589,328 | 6/1971 | Kiniry | 116/63 P |
| 3,596,627 | 8/1971 | Monk | 40/612 X |
| 3,662,482 | 5/1972 | Sarkisian | 404/606 X |
| 3,925,929 | 12/1975 | Montgomery | 404/6 X |
| 4,126,403 | 11/1978 | Sweeney | 404/10 X |

*Primary Examiner*—Nile C. Byers, Jr.

*Attorney, Agent, or Firm*—Zarley, McKee, Thomte, Voorhees & Sease

[57] ABSTRACT

A plurality of signboards on a pair of legs are pivotally connected to a base and held in a vertical position by shear pins adapted to shear upon a predetermined impact force being directed against the signboards from either direction thereby allowing the legs to pivot to a collapsed horizontal position.

5 Claims, 7 Drawing Figures

COLLAPSIBLE BARRICADE

BACKGROUND OF THE INVENTION

Conventional barricades made from wood 2×4 are normally constructed as a solid integral structure and upon being hit by an automobile literally explode with pieces flying in all directions thereby endangering the occupants of the vehicle by pieces entering the passenger compartment of the vehicle through the windshield. Additionally, these barricade structures are totally destroyed upon being hit thereby requiring a new barricade structure.

A collapsible barricade structure having reusable parts is needed that will not fly apart upon contact by a moving vehicle but will fold flat and allow the vehicle to pass over it.

SUMMARY OF THE INVENTION

The barricade structure of this invention includes reusable parts and will not self-destruct upon impact by a moving vehicle thereby eliminating risk of injury to the occupants of the vehicle. The upright posts of the barricade are connected to the base by pivot pins and are locked in a vertical position by shear pins which will shear upon a predetermined impact force being directed against the legs. The shear pins are preferably located above the pivot pins but may be located at any point radially outwardly of the pivot pin axis. With the legs being able to pivot the impact force is minimized since the legs will pivot immediately upon a predetermined amount of impact force being applied against the signboards connecting the legs together. Frequently the legs and signboards may be reused by inserting new shear pins in the legs for locking them in a vertical position on the base.

DESCRIPTION OF THE PREFERRED EMBODIMENT

Figure 1:
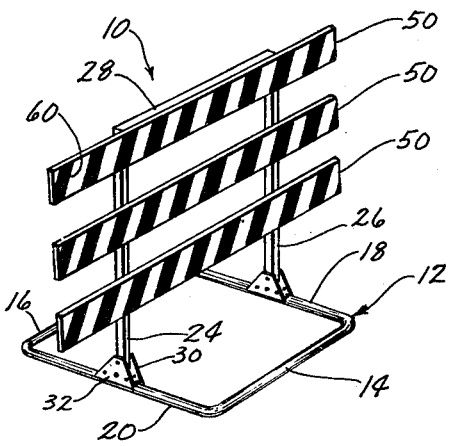
FIG. 1 is a perspective view of the collapsible barricade.
Figure 2:
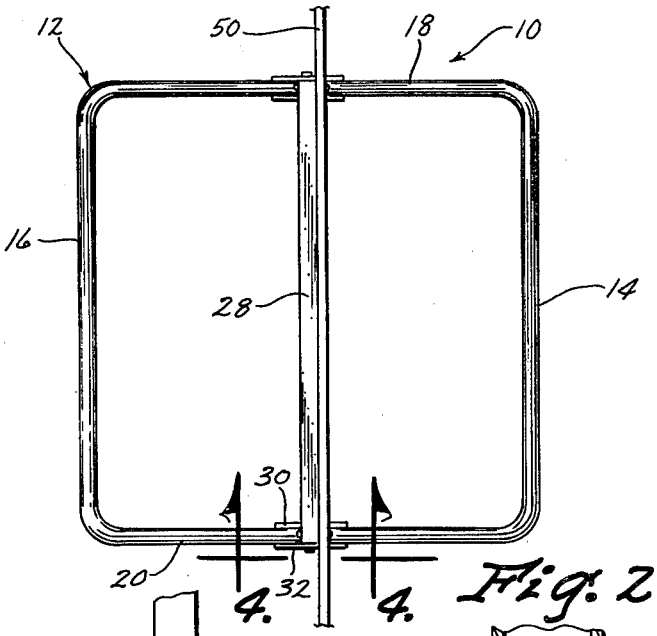
FIG. 2 is a perspective view of the pivotal connection of the barricade legs to the base showing the pivot pin and the shear pin connecting the leg to the base.

The collapsible barricade of this invention is referred to generally in FIG. 1 by the reference numeral 10 and includes a rectangular base of tubular construction having opposite end portions 14 and 16 which interconnect side members 18 and 20. A pair of legs 24 and 26 of metal tubular construction are interconnected at the top by a cross member 28 and extend between bracket plates 30 and 32 welded to the side members 18 and 20.

Figure 3:
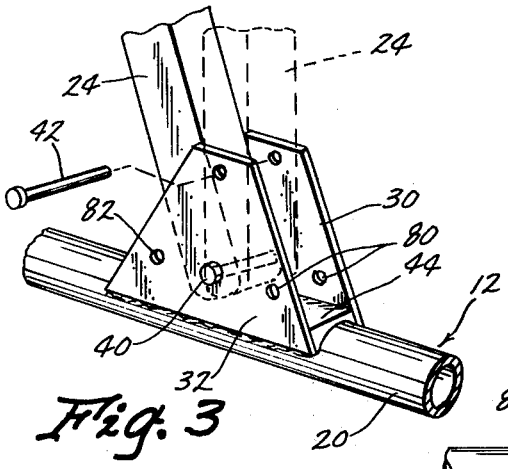
FIG. 3 is an enlarged perspective view of the pivotal connection between the leg and base.
Figure 4:
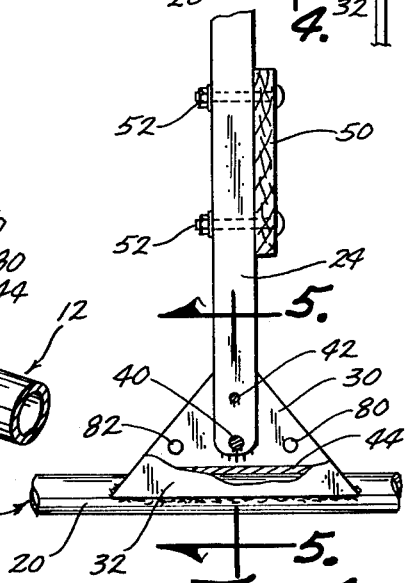
FIG. 4 is a cross-sectional view taken along line 4—4 in FIG. 2.

As seen in FIG. 3, a pivot pin 40 extends through the plates 20 and 32 and through the lower end of the leg 24 with a shear pin 42 positioned above the pivot pin 40 also extending through the bracket plates 30 and 32 and the leg 24. A spacer element through the bracket plates 30 and 32 and the leg 24. A spacer element 44 is positioned against the leg 20 and interconnects the plates 30 and 32.

Three signboards 50 are connected by bolts 52 to the legs 24 and 26 and include reflective material 60 for warning oncoming motorists of the barricade's presence.

Figure 5:
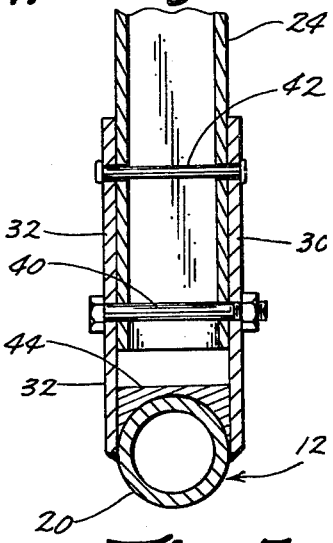
FIG. 5 is a cross-sectional view taken along line 5—5 in FIG. 4.
Figure 6:
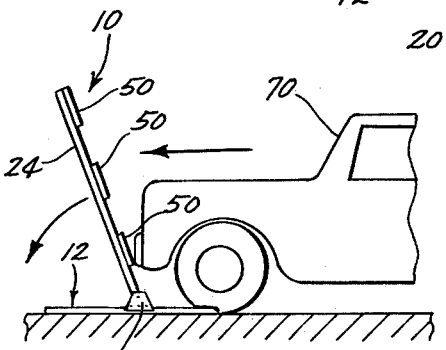
FIG. 6 is a side elevational view showing the barricade pivoting downwardly away from the vehicle which is directing an impact force against it.

It is seen in FIG. 5 that the shear pin 42 is of a smaller diameter than the pivot pin 40 and thus will shear while the legs pivot about the pivot pin 40. The shear pin 42 could be located in any radial position relative to the pivot pin 40 but is preferably positioned above the pivot pin.

Figure 7:
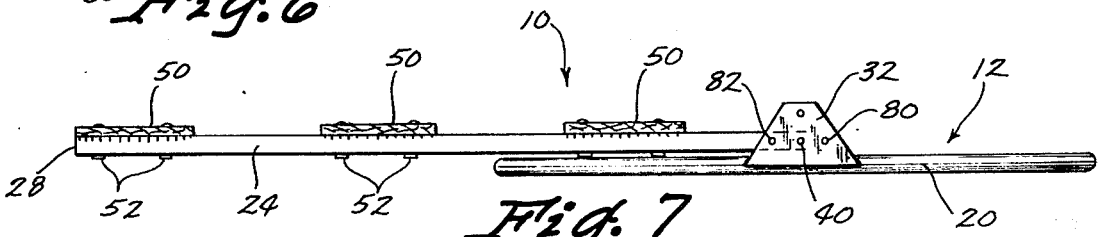
FIG. 7 is a side elevational view of the barricade in its horizontal collapsed position.

In operation the collapsible barricade structure is in an upstanding position as shown in FIG. 1, and upon a vehicle 70 inadvertently making contact therewith the impact force will cause the shear pin 42 to shear and allow the structure to pivot away from the vehicle downwardly to the collapsed position of FIG. 7 where the legs are parallel to and flat against the base 12 leaving only the mounting bracket plates 30 and 32 standing. If the legs and the signboards have not been damaged by the impact the barricade may be pivoted to its vertical position again with a new shear pin 42 being inserted. It is seen that the impact from the vehicle 70, however substantial will not separate the barricade structure from its base or cause the signboards 50 to be separated from the legs 24 and 26 thereby eliminating an otherwise dangerous situation that would occur if pieces were caused to fly through the air and perphaps through the windshield of the vehicle.

The barricade structure may be stored in its collapsed position and in such event the shear pins 42 may be inserted through either of the aligned holes 80 or 82 in the bracket plates 30 and 32 to lock the legs 24 and 26 in the collapsed position of FIG. 7. It is noted in the collapsed position that the maximum height of the structure is approximately seven inches thereby easily allowing vehicles to pass thereover without damage to the structure or the vehicle.

I claim:

1. A collapsible portable barricade comprising:

a base frame lying approximately in a single plane and having a forward frame member, a rearward frame member and opposite side frame members;

each of said side frame members having a bracket attached thereto intermediate the opposite ends thereof;

a pair of leg members having upper and lower ends;

at least one display cross member extending transversely of and interconnecting said leg members;

hinge means including a pivot pin connecting each of said leg members to one of said brackets adjacent said lower ends of said leg members for pivotal movement about a horizontal hinge axis, said legs being pivotal approximately 180° from a first horizontal position to a vertical position to a second horizontal position, said legs having locking holes extending therethrough and located in spaced relation to said hinge axis, said brackets each having a first hole, a second hole and a third hole positioned to register with said locking holes when said leg members are in said first horizontal position, said vertical position and said second horizontal position, respectively, a shear pin extending through said locking holes, and one of said first, second and third holes, said shear pin being removable to permit movement of said leg members between said first horizontal, vertical and second horizontal positions, and said shear pin being adapted to shear in response to a predetermined impact force being directed to said leg, so that said legs will pivot to one of said horizontal positions in response to said impact force.

2. The structure of claim 1 wherein said legs in said horizontal positions are flat against and parallel to said base.

3. The structure of claim 1 wherein said shear pin is smaller in diameter than said pivot pin whereby pivoting occurs about the axis of said pivot pin and said shear pin is sheared upon said impact force being directed against said legs.

4. The structure of claim 1 wherein said legs are of metal tube material and said legs are interconnected by wood signboards.

5. The structure of claim 1 wherein said legs are capable of pivoting towards either of said opposite ends of said base and said legs are positioned midway between said opposite ends of said base.

* * * * *